United States Patent [19]

Marlow

[11] Patent Number: 4,467,724

[45] Date of Patent: Aug. 28, 1984

[54] SABOT PROJECTILE CORE RESTRAINT

[75] Inventor: Darrell W. Marlow, Carbondale, Ill.

[73] Assignee: Olin Corporation, Stamford, Conn.

[21] Appl. No.: 413,017

[22] Filed: Aug. 30, 1982

[51] Int. Cl.[3] ..... F42B 13/16
[52] U.S. Cl. ..... 102/520
[58] Field of Search ..... 102/520–523, 102/703

[56] References Cited

U.S. PATENT DOCUMENTS 3,507,221 4/1970 Grolly ..... 102/523
3,771,458 11/1973 Schweimler et al. ..... 102/523

FOREIGN PATENT DOCUMENTS 2738121 3/1979 Fed. Rep. of Germany ..... 102/521

*Primary Examiner*—Harold J. Tudor
*Attorney, Agent, or Firm*—Bruce E. Burdick

[57] ABSTRACT

A discarding sabot projectile is disclosed which includes a smooth cylindrical projectile core with a reduced diameter nose and a sabot surrounding the projectile. A restraint device is positioned between the front of the sabot and the nose of the core for normally preventing forward movement of the projectile core relative to the sabot and disengaging from the sabot or core in response to spin-up of the sabot projectile during firing to allow substantially unencumbered separation of the core from the sabot.

1 Claim, 2 Drawing Figures

SABOT PROJECTILE CORE RESTRAINT

BACKGROUND AND SUMMARY OF INVENTION

This invention relates to ammunition and to discarding sabot projectiles. There is a need for a means for retaining the projectile core in the sabot so that the projectile core is not forced out of the sabot by the debulleting loads during ramming of the projectile in the gun. For automatic weapons the debulleting load is frequently in excess of 3000 g's. If a retainer were not used the relatively heavy core could move forward during ramming and separate from the relatively light sabot of the projectile possibly exiting the gun barrel before the round was fired. To prevent this a common conventional technique is using a split retaining ring with a matching groove in the sabot body and penetrator. During projectile spin-up as it travels down the barrel the split retaining ring centrifuges out of a groove in the penetrator and into a deeper outer groove in the sabot and no longer prevents the penetrator from separating from the sabot during normal separation. The problem with this design is that it requires the machining of an internal groove in the sabot, usually at the base of the sabot internal cavity which is difficult and expensive. Also, a matching groove must be machined in the penetrator outside diameter. This weakens the penetrator by virtue of creating a stress riser and reduces the penetrating capability of the penetrator as compared to a penetrator without the groove.

The invention has sought to overcome this problem by the use of either "fingers" that are crimped onto the projectile core nose section or an "O" ring that is in frictional contact with the core. As the core tries to move forward it applies a frictional load to the "O" ring, wedging it between the core and sabot body preventing forward movement. During spin-up the "O" ring moves outward into the groove since no wedging or frictional loads are applied, but rather the inertia of the projectile core forces it backward relative to the sabot upon firing and during spin-up.

The invention will be better understood by reference to the attached drawing in which FIG. 1 is a partial longitudinal cross section through a sabot projectile embodying the invention; and FIG. 2 is a partial longitudinal cross section through a sabot projectile embodying a second version of the invention.

DETAILED DESCRIPTION

Figure 1:
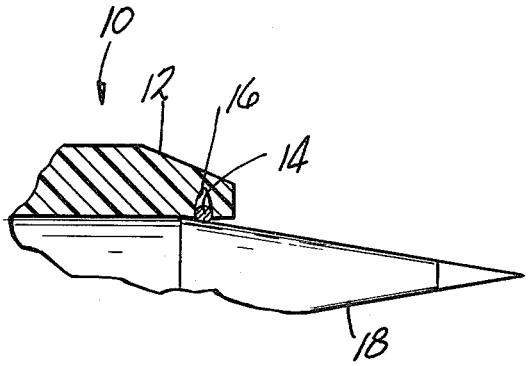
Figure 2:
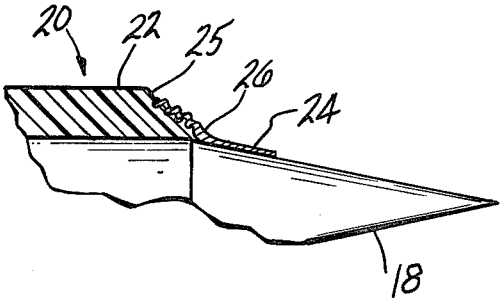

Referring to FIG. 1 the forward end 12 of a sabot 10 has portions defining an annular radial recess 16 in which an O-ring 14 of rubber or other suitable material is located. A projectile core or penetrator 11 is located within the core. Penetrator 11 has a nose portion 18 of reduced diameter. Recess 16 is located just forward of the start of nose 18 so that "O" ring 14 normally lies partly in and partly out of recess 16 such that forward movement of nose 18 is limited by the wedging of O ring 14 against the forward wall of recess 16. However, when the sabot projectile which incorporates sabot 10 and nose 18 spins rapidly as occurs during firing "O" ring is centrifuged outwardly into groove 16 and does not restrain nose 18. FIG. 2 is a modified sabot 20 with a restraint means which utilizes a crimped finger-like restraint instead of the O-ring and groove of sabot 10. Sabot 20 has a forward portion 22 with a ribbed recess 25 into which a soft metallic or plastic restraint 26 is crimped. Restraint 26 has an extension finger 24 which prevents forward movement of core 18 relative to sabot 20 until spin-up when finger 24 is centrifuged outwardly to allow such forward movement.

This invention advantageously eliminates the need for an externally grooved penetrator and thus increases the penetrating ability of the penetrator when it strikes its intended target.

I clam:

1. A discarding sabot projectile which comprises:

a cylindrical projectile core with a rear portion and reduced diameter front portion and a smooth unrecessed exterior, a sabot radially surrounding said rear portion of said core and having a forward end which has an inwardly facing annular recess at a location radially outward of said front portion of said core, and a centrifugally expandable O ring of a cross-sectional body diameter greater than the radial distance between said forward end and said front portion at the location of said sabot recess, said "O" ring positioned partially within said recess when in contact with said smooth reduced diameter front portion, said sabot recess being of a depth greater than said O ring body diameter whereby said O ring can expand outwardly into said recess when said projectile is spun-up during firing.

* * * * *